US009176444B2

(12) United States Patent
Kato et al.

(10) Patent No.: US 9,176,444 B2
(45) Date of Patent: Nov. 3, 2015

(54) FIXING UNIT POSITION-ADJUSTING APPARATUS AND IMAGE FORMING APPARATUS

(71) Applicants: Yuichiro Kato, Kanagawa (JP); Yoshikuni Sasaki, Kanagawa (JP); Tsukasa Satoh, Kanagawa (JP)

(72) Inventors: Yuichiro Kato, Kanagawa (JP); Yoshikuni Sasaki, Kanagawa (JP); Tsukasa Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 53 days.

(21) Appl. No.: 14/141,281

(22) Filed: Dec. 26, 2013

(65) Prior Publication Data

US 2014/0193175 A1 Jul. 10, 2014

(30) Foreign Application Priority Data

Jan. 9, 2013 (JP) ..... 2013-001668

(51) Int. Cl.
*G03G 15/16* (2006.01)
*G03G 15/20* (2006.01)
*G03G 21/16* (2006.01)

(52) U.S. Cl.
CPC ..... *G03G 15/2071* (2013.01); *G03G 15/2017* (2013.01); *G03G 15/2035* (2013.01); *G03G 21/1685* (2013.01)

(58) Field of Classification Search
CPC ..... G03G 15/2017; G03G 15/2035; G03G 15/2071; G03G 21/1685
USPC ..... 399/122
See application file for complete search history.

(56) References Cited

U.S. PATENT DOCUMENTS

2009/0263155 A1* 10/2009 Murano ..... 399/107

FOREIGN PATENT DOCUMENTS

JP 2004-117395 4/2004

* cited by examiner

*Primary Examiner* — David Gray
*Assistant Examiner* — Thomas Giampaolo, II
(74) *Attorney, Agent, or Firm* — Duft Bornsen & Fettig LLP

(57) ABSTRACT

The present invention is concerning to a fixing unit position-adjusting apparatus including: a first member configured to include a positioning portion that is formed on a lateral surface of the first member, the positioning portion being engaged with a positioning portion of a main body so that the first member is mounted on the main body in a manner positionable in a left and right direction; and a second member configured to include a reference pin insertion portion that is formed to receive insertion of a reference pin of the main body, the second member being assembled with the first member.

5 Claims, 4 Drawing Sheets

FIXING UNIT POSITION-ADJUSTING APPARATUS AND IMAGE FORMING APPARATUS

CROSS-REFERENCE TO RELATED APPLICATIONS

The present application claims priority to and incorporates by reference the entire contents of Japanese Patent Application No. 2013-001668 filed in Japan on Jan. 9, 2013.

BACKGROUND OF THE INVENTION

1. Field of the Invention

The present invention relates to a fixing unit position-adjusting apparatus for positioning a fixing unit which fixes a toner image on a record medium, such as a recording paper sheet, with respect to a main body of an image forming apparatus, and to an image forming apparatus.

2. Description of the Related Art

Image forming apparatuses which form an image on a recording paper sheet with an electrophotographic system have conventionally been used as copying machines, facsimile machines, and printers. Such an electrophotographic image forming apparatus charges a photoreceptor with a charging apparatus, and then forms an electrostatic latent image on the surface of the photoreceptor through such operation as optical writing performed in accordance with a document image or image information. The electrostatic latent image is then developed by a developing apparatus into a toner image with use of a toner. The toner image that is a visible image is transferred onto a recording paper sheet that is a recording medium. The recording paper sheet is then heat-pressurized by a fixing unit so that the toner image is fixed onto the recording paper sheet. Thus, copied sheets and printed sheets are obtained.

One example of the fixing unit for use in image forming apparatuses is a roller-type fixing unit made up of a heating roller having a heat source and a pressure roller that rotates in contact with the heating roller. The roller-type fixing unit applies heat and pressure to a recording paper sheet, which has been conveyed to between the heating roller and the pressure roller, to fix a toner image thereon. Another example is a belt-type fixing unit having an endless fixing belt stretched over between the heating roller and the fixing roller. The belt-type fixing unit applies heat and pressure to a recording paper sheet, which has been conveyed to between the fixing belt and the pressure roller, to fix a toner image thereon.

Image forming apparatuses are required to support a wide variety of recording paper sheets, ranging from extra large-size paper sheets that are one size larger than standardized sizes to small postcard sheets with a relatively small size as well as from super-thin paper sheets to super-thick paper sheets. At the same time, high productivity and high image quality are also required. However, it was difficult to satisfy both conveying performance and image quality for the recording paper sheets.

When the positioning accuracy of the fixing unit with respect to the recording paper sheets are poor, the recording paper sheets may enter into the fixing unit with a displaced position, which causes distorted images, generation of wrinkles, edges of the recording paper sheets being folded, and occurrence of paper jam. In such circumstances, enhanced positioning accuracy of the fixing unit is required. In response to such requirements, an adjustment mechanism is used, that adjusts a reference pin of the fixing unit in a conveyance direction.

In one example, the adjustment mechanism is adapted to fix the position of a reference pin on the rear side of the fixing unit while adjusting the position of a reference pin on the near side of the fixing unit in the conveyance direction so as to optimize the parallelism of the fixing unit with respect to the recording paper sheets.

Japanese Laid-open Patent Publication No. 2004-117395 discloses an image forming apparatus including a retract drive means for use in retracting a fixing unit into a main body of the image forming apparatus so as to set the fixing unit in the image forming apparatus. The retract drive means slides the fixing unit in a fixing unit insertion direction so that the fixing unit is retracted to and positioned at a proper position.

However, when the adjustment mechanism is provided, a parts count increases as a plurality of component members need to be added. This causes a problem of a complicated configuration of the apparatus. Similarly, in the case of providing the retract drive means described in Japanese Laid-open Patent Publication No. 2004-117395, the parts count increases as a structure for sliding the fixing unit is needed. This also causes the problem of the complicated configuration of the apparatus.

In view of the above-mentioned conventional art, there is need to provide a fixing unit position-adjusting apparatus which can position the fixing unit with a simple configuration and which can optimize the parallelism of the fixing unit with respect to recording paper sheets that enter into the fixing unit.

SUMMARY OF THE INVENTION

It is an object of the present invention to at least partially solve the problems in the conventional technology.

According to the present invention, there is provided: a fixing unit position-adjusting apparatus for adjusting a position of a fixing unit with respect to a main body of an image forming apparatus, comprising: a first member configured to include a positioning portion that is formed on a lateral surface of the first member, the positioning portion being engaged with a positioning portion of the main body so that the first member is mounted on the main body in a manner positionable in a left and right direction; and a second member configured to include a reference pin insertion portion that is formed to receive insertion of the reference pin of the main body, the second member being assembled with the first member.

In the above-described fixing unit, in a state where the first member and the second member are assembled and the reference pin of the main body is inserted into the reference pin insertion portion, the first member and the second member are provided in between the fixing unit and the main body so as to mount the fixing unit on the main body in a position adjustable manner.

The present invention also provides an image forming apparatus that includes the above-defined fixing unit position-adjusting apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
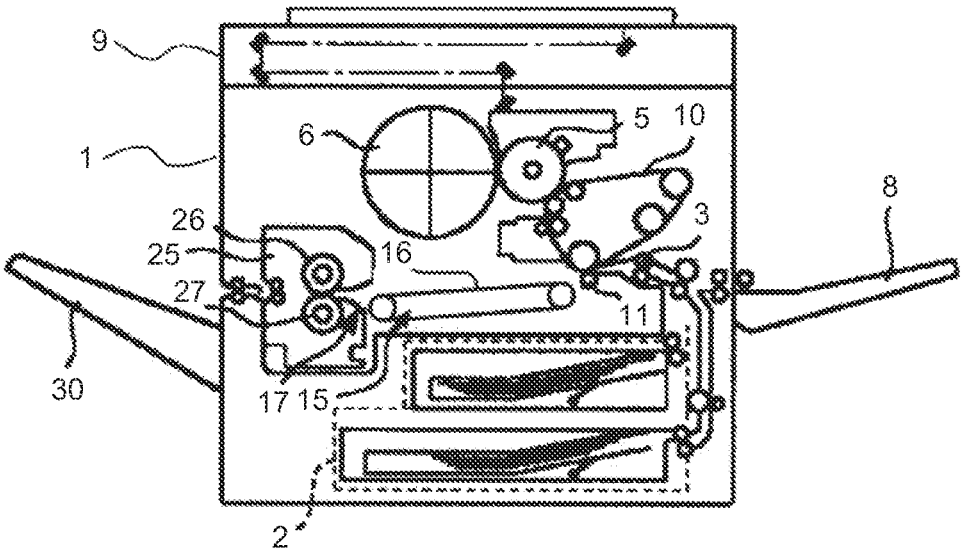
FIG. 1 is a schematic configuration view of an image forming apparatus according to an embodiment of the present invention.

FIG. 1 is a schematic configuration view illustrating an image forming apparatus according to an embodiment of the present invention. Examples of the image forming apparatus of the present embodiment may include a copying machine, a facsimile machine, and a printer, which records an image on a recording paper sheet used as a recording medium according to an electrophotographic system.

The image forming apparatus of the present embodiment has a main body 1 which houses each member arranged around a drum-like photoreceptor 6. An exposure apparatus 9 is provided on top of the main body 1. The exposure apparatus 9 is configured to irradiate the surface of the photoreceptor 6 with a laser beam to form an electrostatic image.

Inside the main body 1, a transfer roller 5, a primary transfer belt 10, a secondary transfer roller 11, an intermediate conveyance unit 15, and a fixing unit 25 are arranged around the photoreceptor 6. Recording paper sheets are conveyed from a paper feeding tray 2 or a manual feeding tray 8.

Formation of an image with the image forming apparatus of the present embodiment is performed as shown below. First, a recording paper sheet which is a recording medium fed from the manual feeding tray 8 or the paper feeding tray 2 is temporarily stopped at a registration roller 3. At this time, a toner image is formed on the primary transfer belt 10 through basic electrophotographic processes including reading, writing, charging, exposing, developing, and primary transfer, which are performed in this order in parallel with feeding of the recording paper sheet. In response to this image formation, the recording paper sheet is restarted from the registration roller 3 and passes through a nip formed between the primary transfer belt 10 and the secondary transfer roller 11. By passing through the nip, an unfixed toner image is formed on the surface of the recording paper sheet.

Then, the recording paper sheet is conveyed to the fixing unit 25 by a conveying belt 16 included in an intermediate conveyance unit 15. The recording paper sheet is then guided by a fixing entrance guide plate 17 into the fixing unit 25. When the recording paper sheet enters into the nip formed from the fixing roller 26 and the pressure roller 27, an unfixed toner image on the surface of the recording paper sheet is fixed to be a semipermanent image. The recording paper sheet is then discharged to a paper discharge tray 30.

The fixing unit 25 is positioned on the main body 1 of the image forming apparatus. The positioning is performed with use of reference pins. A main reference and a sub reference are each provided on the front side and the rear side of the main body. The main reference is formed as a round hole, while the sub reference is formed as a noncircular hole, such as an elongated hole and an ellipse hole, to position and fix the fixing unit 25.

At the time of the positioning, if the parallelism of the fixing unit 25 with respect to upstream units is disturbed, the position of the recording paper sheets, which are conveyed into the nip formed from the fixing roller 26 and the pressure roller 27 of the fixing unit 25, is displaced. This causes distorted images, generation of wrinkles, edges of the recording paper sheets being folded, and occurrence of paper jam. In order to solve this problem, as illustrated in FIGS. 2 to 8, the image forming apparatus of the present embodiment includes a position adjusting apparatus 4 that adjusts the position of the fixing unit 25 with respect to the main body 1.

Figure 2:
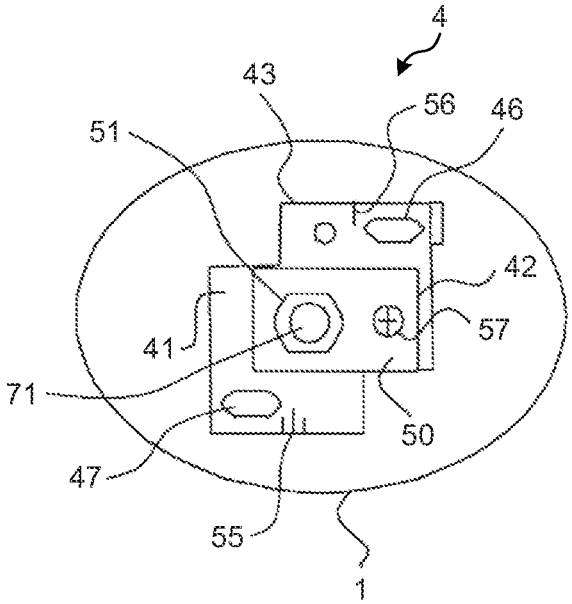
FIG. 2 is a front view illustrating an assembled state of a position-adjusting apparatus in the embodiment of the present invention.
Figure 3:
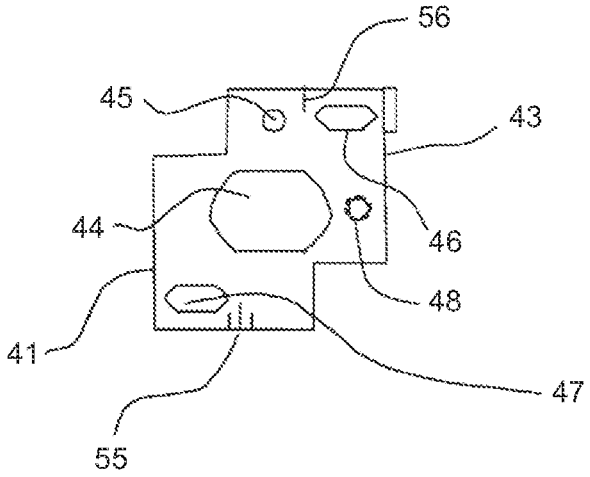
FIG. 3 is a front view illustrating a first member of the position adjusting apparatus in the embodiment of the present invention.
Figure 4:
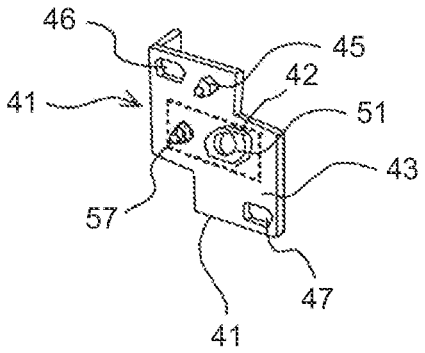
FIG. 4 is a perspective view of the first member in the embodiment of the invention.
Figure 5:
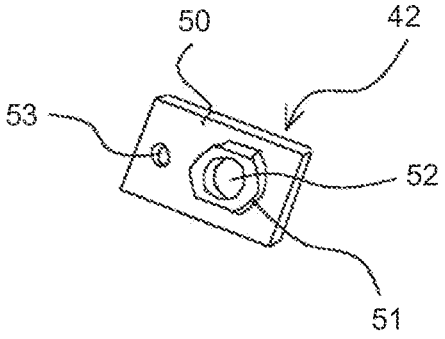
FIG. 5 is a perspective view of a second member in the embodiment of the invention.
Figure 6:
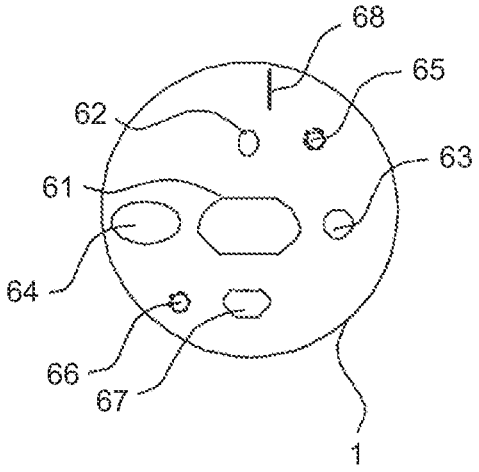
FIG. 6 is a front view illustrating a position adjustment target portion in a main body in the embodiment of the present invention.
Figure 7:
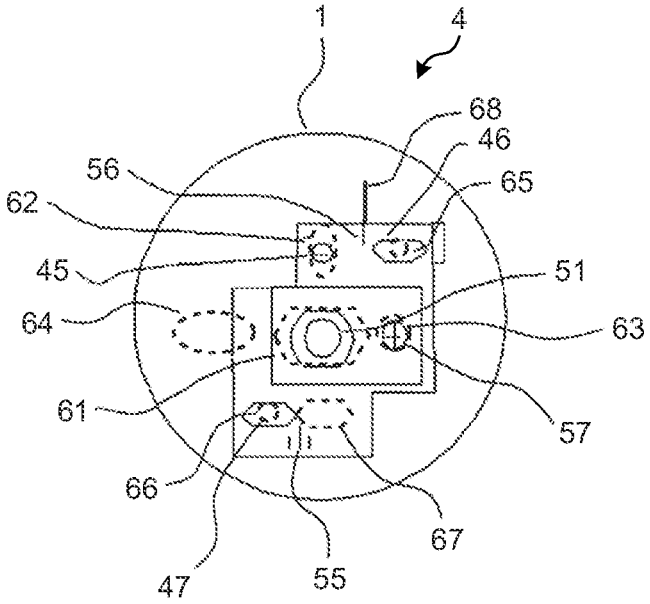
FIG. 7 is a front view illustrating adjustment by the position adjusting apparatus in the embodiment of the present invention.
Figure 8:
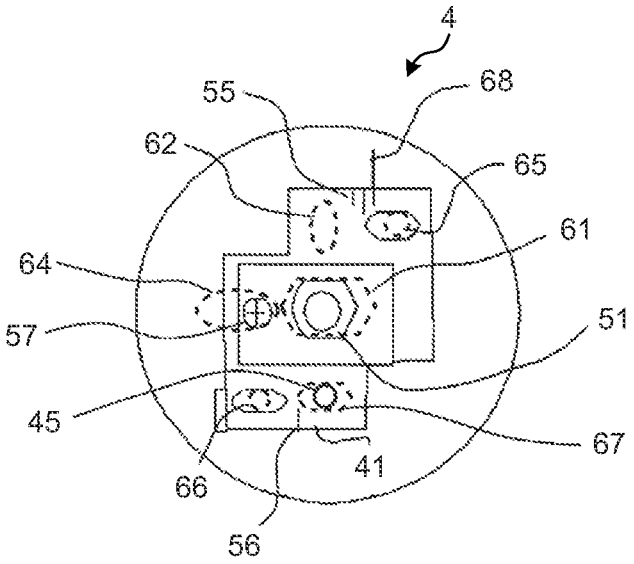
FIG. 8 is a front view illustrating the position adjustment performed with the position adjusting apparatus in an upside down orientation in the embodiment of the present invention.

FIG. 2 is a front view of the position adjusting apparatus 4 of the present embodiment. FIGS. 3 and 4 are respectively a front view and a perspective view of a first member 41 of the present embodiment. FIG. 5 is a perspective view of a second member 42 of the present embodiment. FIG. 6 is a front view illustrating a position adjustment target portion in the main body 1. FIGS. 7 and 8 are front views illustrating position adjustment performed by using the position adjusting apparatus 4 of the present embodiment.

As illustrated in FIG. 2, the position adjusting apparatus 4 of the present embodiment is made up of the first member 41 and the second member 42. The first member 41 and the second member 42 have a member body 43 and a member body 50, respectively, which are each made of a plate material. The first member 41 and the second member 42 are assembled with use of a connection screw 57. In the assembled state, the position adjusting apparatus 4 is mounted on a position adjustment target portion on the side of the main body 1 of the image forming apparatus. As the position adjustment target portion on the side of the main body 1 of the image forming apparatus, a front-side plate or a drawing front-side plate, which is omitted in the drawings, is selected.

FIGS. 3 and 4 illustrate the first member 41 having a mounting hole 44 formed generally in a central portion of the member body 43. Formed around the mounting hole 44 are a positioning pin 45, a first adjusting hole 46, and a second adjusting hole 47. The mounting hole 44 is configured to receive insertion of a reference pin insertion portion 51 of the second member 42 illustrated in later-described FIG. 5. The mounting hole 44 is formed into a horizontally-long noncircular shape such as an ellipse shape. With this configuration, the reference pin insertion portion 51 can slide in a longitudinal direction inside the mounting hole 44.

As illustrated in FIG. 4, the positioning pin 45 is provided so as to protrude on an upper portion of the lateral surface of the first member 41. The positioning pin 45 is inserted into a positioning hole 62 of the main body 1 which is located on a front-side plate or a drawing front-side plate illustrated in later-described FIG. 6.

The first adjusting hole 46 and the second adjusting hole 47 are provided at positions facing each other across the mounting hole 44. As illustrated in FIG. 3, the first adjusting hole 46 is provided on a diagonally upper right side of the mounting hole 44, and the second adjusting hole 47 is provided on a diagonally lower left side of the mounting hole 44. These adjusting holes 46 and 47 are formed into a horizontally-long noncircular shape such as an ellipse shape.

Further as illustrated in FIG. 3, a screw hole 48 for screwing the connection screw 57 is formed in the first member 41.

On a lower portion of the first member 41 in the drawings, an adjustment scale 55 to be used as a guide of position adjustment of the fixing unit 25 is marked, while on an upper portion in the drawings, a reference scale 56 is formed by marking.

FIG. 5 is a perspective view illustrating the second member 42. The member body 50 of the second member 42 has a rectangular plate shape. In the member body 50, the reference pin insertion portion 51 and a screw hole 53 are formed. The reference pin insertion portion 51 having an outline in a noncircular shape such as an ellipse shape is provided so as to protrude from the lateral surface of the member body 50. A reference pin 71 provided on the main body 1 side illustrated in FIG. 2 is inserted into the reference pin insertion portion 51. Accordingly, the reference pin insertion portion 51 is formed so that a circular reference pin insertion hole 52 for inserting the reference pin 71 is formed so as to pierce the portion 51.

FIG. 6 illustrates the position adjustment target portion on the side of the main body 1 of the image forming apparatus. As mentioned before, as the target portion of the main body 1, a front-side plate or a drawing front-side plate of the image forming apparatus is selected. The target portion of the main body 1 has a support hole 61 formed into an elongated hole having a horizontally-long noncircular shape such as an ellipse shape. As illustrated in later-described FIGS. 7 and 8, the reference pin insertion portion 51 of the second member 42 is slidably inserted into the support hole 61.

On an upper portion of the support hole 61 in the drawings, a positioning hole 62 in a vertically-long oval shape is formed. On a lower portion of the support hole 61 in the drawings, a pin clearance hole 67 is formed. On upper and lower portions diagonally across the support hole 61, a first adjusting screw 65 and a second adjusting screw 66 are provided in a protruding manner. These adjusting screws 65 and 66 are inserted into the adjusting holes 46 and 47 of the first member 41. A reference mark 68 is marked on an upper portion of the support hole 61 in the drawings. The reference mark 68 is used as a guide in performing position adjustment of the fixing unit 25. A screw receiving hole 63 for receiving insertion of a shaft section of the connection screw 57 is provided on the right side of the support hole 61 in the drawings.

FIG. 7 illustrates an assembly made by inserting the reference pin insertion portion 51 into the mounting hole 44 and assembling the first member 41 and the second member 42 with use of the connection screw 57. In FIG. 7, the assembly is mounted on the position adjustment target portion on the main body 1 side. When the assembly is mounted on the position adjustment target portion on the main body 1 side, the reference pin insertion portion 51 is inserted in the support hole 61, so that a height direction is put in a regulated state.

Moreover, the positioning pin 45 of the first member 41 is inserted into the positioning hole 62, while the first adjusting screw 65 is inserted into the first adjusting hole 46 of the first member 41, and the second adjusting screw 66 is inserted into the second adjusting hole 47 of the first member 41. At this time, the shaft section of the connection screw 57 is inserted into the screw receiving hole 63 of the main body 1. In FIG. 7, the reference scale 56 of the position adjusting apparatus 4 is aligned with the reference mark 68 of the main body 1. This indicates that the fixing unit 25 is assembled at a proper reference position.

FIG. 8 illustrates a case of adjusting the position of the fixing unit 25. In this case, an assembly formed by assembling the first member 41 and the second member 42 is mounted upside down on the position adjustment target portion on the main body 1. Also in this case, the reference pin insertion portion 51 is inserted into the support hole 61 so that the height direction is regulated.

At the same time, the positioning pin 45 of the first member 41 is inserted in the pin clearance hole 67, so that sliding movement in the horizontal direction is not regulated. Accordingly, the positioning pin 45 can be slid in the horizontal direction for position adjustment. In this case, the shaft section of the connection screw 57 is inserted into a screw clearance hole 64 to prevent interference thereby. After position adjustment is completed, the adjusting screws 65 and 66 are used to fix the fixing unit 25.

FIG. 8 illustrates the case where the position adjusting apparatus 4 is moved leftward with respect to the main body 1 for position adjustment. FIG. 8 implies that the adjustment scale 55 was displaced leftward from the reference mark 68, and so the position was adjusted in the left direction. Note that similar adjustment may also be performed in the right direction.

In the present invention as described in the foregoing, the position of the fixing unit 25 can be adjusted by assembling the first member 41 and the second member 42, inserting the reference pin 71 into the reference pin insertion portion 51, and moving the first member 41 in this state in the left and right direction. As a result, the fixing unit 25 can be positioned with a simple configuration. Therefore, it becomes possible to optimize the parallelism of the fixing unit 25 with respect to the recording paper sheets that enter into the fixing unit 25.

In the embodiment disclosed with referring FIG. 7, the positioning pin 45 is used as a positioning portion of the position adjusting apparatus 4, and the positioning hole 62 is used as a positioning portion on the main body 1 side that engages with the positioning pin 45. However, the positioning pin 45 and the positioning hole 62 may be reversed in this invention. That is, a positioning hole may be formed in the position adjusting apparatus 4, and a positioning pin may be formed on the main body 1 side.

According to the present invention, the position of the fixing unit can be adjusted by assembling the first member and the second member, inserting the reference pin of the main body into the reference pin insertion portion, and moving the first member in the left and right direction. This makes it possible to position the fixing unit with a simple configuration and to also optimize the parallelism of the fixing unit with respect to recording paper sheets that enter into the fixing unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing unit position-adjusting apparatus for adjusting a position of a fixing unit with respect to a main body of an image forming apparatus, comprising:

a first member configured to include a positioning portion that is formed on a lateral surface of the first member, the positioning portion being engaged with a positioning portion of the main body so that the first member is mounted on the main body in a manner positionable in a left and right direction; and a second member configured to include a reference pin insertion portion that is formed to receive insertion of a reference pin of the main body, wherein the first member includes a mounting hole configured to receive the reference pin insertion portion of the second member for assembling the first member and the second member, the mounting hole having a non-circular shape to enable the second member to move in the left and right direction with respect to the first member, and the main body configured to receive the first member and the second member in an assembled state for mounting the fixing unit to the main body, wherein the main body includes a support hole having a non-circular shape and configured to receive the reference pin insertion portion of the second member to enable the first member and the second member to move in the left and right direction with respect to the main body.

2. The fixing unit position-adjusting apparatus according to claim 1, wherein the first member is configured to further include adjusting holes that are formed on upper and lower portions on the lateral surface of the first member, the adjusting holes receiving insertion of adjusting screws of the main body in a position adjustable manner.

3. The fixing unit position-adjusting apparatus according to claim 1, wherein the first member is configured to include an adjustment scale that is formed to be used as a guide of position adjustment with respect to the main body.

4. The fixing unit position-adjusting apparatus according to claim 1, wherein the first member and the second member include corresponding screw holes for receiving a connection screw that connects the first member and the second member in the assembled state.

5. An image forming apparatus including a fixing unit and a fixing unit position-adjusting apparatus for adjusting a position of the fixing unit with respect to a main body of the image forming apparatus, wherein the fixing unit position-adjusting apparatus comprises:

a first member configured to include a positioning portion that is formed on a lateral surface of the first member, the positioning portion being engaged with a positioning portion of the main body so that the first member is mounted on the main body in a manner positionable in a left and right direction; and a second member configured to include a reference pin insertion portion that is formed to receive insertion of a reference pin of the main body, wherein the first member includes a mounting hole configured to receive the reference pin insertion portion of the second member for assembling the first member and the second member, the mounting hole having a non-circular shape to enable the second member to move in the left and right direction with respect to the first member, and the main body configured to receive the first member and the second member in an assembled state for mounting the fixing unit to the main body, wherein the main body includes a a support hole having a non-circular shape and configured to receive the reference pin insertion portion of the second member to enable the first member and the second member to move in the left and right direction with respect to the main body.

* * * * *